US007162898B2

(12) United States Patent
Gogel

(10) Patent No.: US 7,162,898 B2
(45) Date of Patent: Jan. 16, 2007

(54) CROSS BAR SECURITY DEVICE FOR CONTAINER DOOR STANCHIONS

(76) Inventor: Roy E. Gogel, 218 E. Cranberry La., Greenville, SC (US) 29615

( * ) Notice: Subject to any disclaimer, the term of this patent is extended or adjusted under 35 U.S.C. 154(b) by 72 days.

(21) Appl. No.: 11/092,475

(22) Filed: Mar. 29, 2005

(65) Prior Publication Data

US 2006/0012188 A1 Jan. 19, 2006

Related U.S. Application Data

(60) Provisional application No. 60/587,912, filed on Jul. 14, 2004.

(51) Int. Cl.
*E05B 13/08* (2006.01)

(52) U.S. Cl. ..... 70/14; 70/56; 70/200; 70/212; 292/258; 292/259 R; 292/288; 292/298; 292/DIG. 32

(58) Field of Classification Search ..... 70/2, 70/6, 129, 14, 54–56, 199, 200, 211, 212, 70/DIG. 43, DIG. 56; 292/258, 259 R, 289, 292/297, 288, 298, 148, 205, 218, DIG. 32
See application file for complete search history.

(56) References Cited

U.S. PATENT DOCUMENTS 3,664,164 A * 5/1972 Zaidener ..... 70/202
4,003,227 A * 1/1977 Casey ..... 70/14
4,157,653 A * 6/1979 Dohanyos ..... 70/417
4,866,960 A * 9/1989 Brower ..... 70/56
5,035,127 A * 7/1991 Larsen ..... 70/56
5,118,149 A * 6/1992 Emmons ..... 292/327
5,145,222 A * 9/1992 Meyer ..... 292/258
5,284,036 A * 2/1994 Rosenbaum ..... 70/14
5,701,768 A * 12/1997 Khalsa ..... 70/14
5,737,946 A * 4/1998 Sole et al. ..... 70/54
5,806,352 A * 9/1998 Axford ..... 70/56
5,857,721 A * 1/1999 Liroff ..... 292/307 R
6,357,266 B1 * 3/2002 Van Buren ..... 70/56
6,357,292 B1 * 3/2002 Schultz et al. ..... 73/146.5
6,463,769 B1 * 10/2002 Garner ..... 70/56
6,581,419 B1 * 6/2003 Strodtman ..... 70/56
6,823,701 B1 * 11/2004 Gogel ..... 70/32
6,915,670 B1 * 7/2005 Gogel ..... 70/32
6,983,629 B1 * 1/2006 Gogel ..... 70/14
7,047,774 B1 * 5/2006 Gogel ..... 70/32
2004/0200246 A1 * 10/2004 Witchey ..... 70/14

* cited by examiner

*Primary Examiner*—Brian E. Glessner
*Assistant Examiner*—Carlos Lugo
(74) *Attorney, Agent, or Firm*—Charles L. Schwab; Nexsen Pruet, LLC

(57) ABSTRACT

A security device is provided for a cargo container having doors hinged on vertical axis, which are locked by vertical stanchions. The locking device includes a housing and a hook. The hook has a pair of vertically spaced claws, which are placed around a stanchion in straddling relation to a pair of parallel brackets to which the stanchion operating lever is pivotally connected. The housing of the locking device has a cross bar which confronts the pivot brackets, thereby preventing rotation of the stanchion when the housing and hook are coupled by a puck lock.

6 Claims, 2 Drawing Sheets

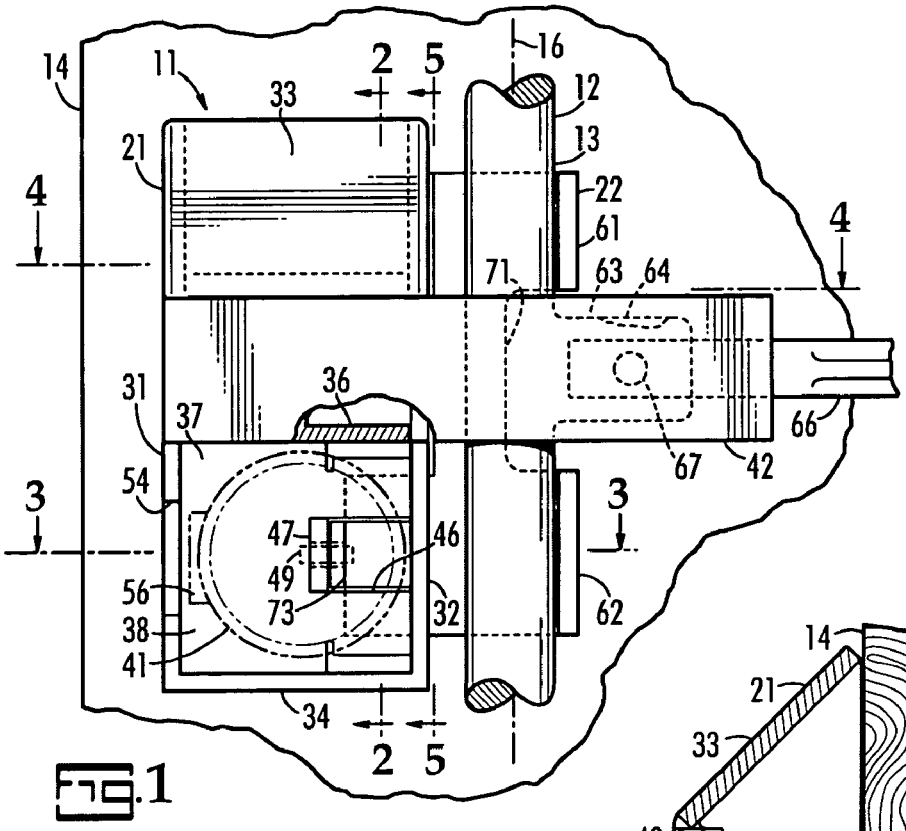
FIG.1
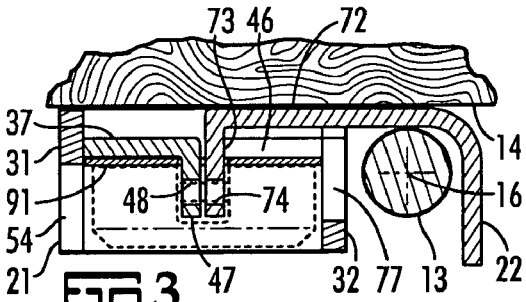
FIG.3
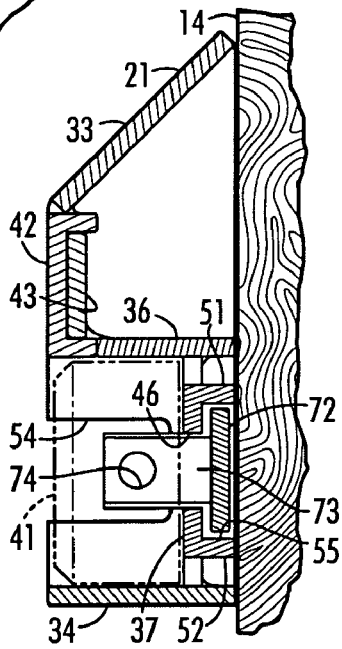
FIG.2
FIG.4
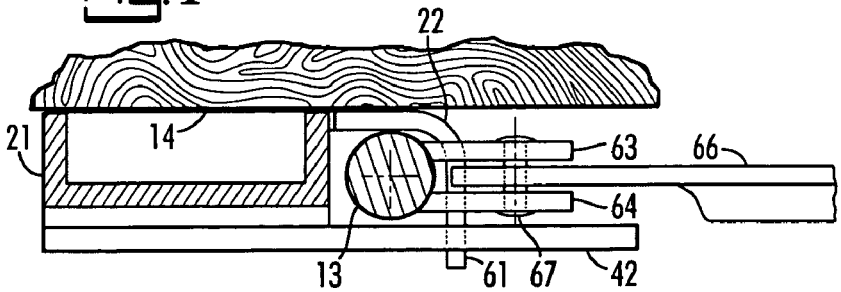

CROSS BAR SECURITY DEVICE FOR CONTAINER DOOR STANCHIONS

RELATED PATENT APPLICATION

Features of this invention are disclosed in U.S. provisional patent application Ser. No. 60/587,912 filed Jul. 14, 2004, for a Security Device for Container Door Stanchions for which benefit under 35 U.S.C. 120 is claimed.

BACKGROUND OF THE INVENTION

This invention is a device for preventing unauthorized opening of the doors of a cargo container of the type used on truck trailers or on storage or construction containers. Such containers customarily have two doors hinged to laterally opposite sides of the rear of the container on vertical axes and the doors are latched in their closed position by vertical stanchions mounted on the outside of the doors. The stanchions have latching fingers at their tops and bottoms which engage keeper pockets at the top and bottom of the rear of the container when the stanchions are pivoted about their axes. The trailer bodies or containers are also designed such that the left door is typically closed and secured first and opened last. The right door is designed with a seal around the periphery of the door and its size is such that when closed, the right door retains the left door in a secure position. Consequently, the right door is typically the first door opened and the last closed. Although various locking devices have been proposed for the handles provided for rotating the stanchions, thieves using bolt cutters, power hack saws and sledgehammers are all too frequently destroying the locking devices.

SUMMARY OF THE INVENTION

The security device of this invention locks the vertical stanchion of the right door and utilizes the container's inherent infrastructure to retain the left door in a secured position, thus preventing the doors of the cargo container or trailer from being opened. This security device is portable; that is, it is not permanently secured to the doors or their stanchions. The security device has a housing and a hook with vertically spaced claws that slide under the right door's inner vertical stanchion and above and below the latterly extending brackets on the stanchion to which its operating handle is pivoted. The housing has a cavity for a puck lock and the back wall of the cavity has a tab with an opening for reception of the locking bar of a puck lock. The hook includes a flat projection or palm, which fits in a guideway in the housing and includes an arm with an opening that is engaged by the locking bar of a puck lock. The housing includes a cross bar which covers the handle pivot brackets on the stanchion when the device is installed, thereby preventing rotation of the stanchion, and maintaining the stanchion in a locked position. When the device is locked to the stanchion, the shackleless puck lock is protected by the housing walls defining a cavity in which the lock rests.

BRIEF DESCRIPTION OF THE DRAWINGS

One embodiment of the invention is illustrated in the drawings in which:

FIG. 1 is a front view of a security device installed on a stanchion;

FIG. 2 is a section taken on line 2—2 in FIG. 1;

FIG. 3 is a section taken on line 3—3 in FIG. 1;

FIG. 4 is a section taken on line 4—4 in FIG. 1;

DETAILED DESCRIPTION OF THE INVENTION

Figure 5:
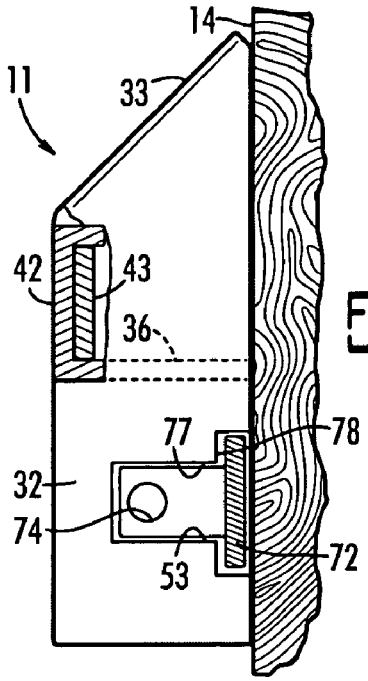
FIG. 5 is a section taken on line 5—5 in FIG. 1.

FIG. 1 shows the security device 11 installed on a stanchion 12 for the right hand rear door 14 of a tractor-trailer. The stanchion 12 includes a cylindrical rod 13 journaled on the door 14 for pivotally movement about the axis 16 of the rod 13 between locking and unlocking positions. The stanchion 12 has latching fingers, not shown, at its top and bottom, which engage keeper pockets in the trailer when the stanchion 12 is pivoted about its axis 16. The security device 11 is portable. It attaches only to the stanchion 12. The security device 11 has two main components, namely, a housing 21 and a hook 22. The housing 21 has a pair of parallel laterally spaced side walls 31, 32, a sloping roof 33, a lower wall 34, an intermediate or upper wall 36 and a back wall 37. The side walls 31, 32, the lower wall 34, the upper wall 36 and the back wall 37 are rigidly interconnected, as by welding, and form a pocket or cavity 38 for a puck lock, shown by broken lines 41. The side wall 31 has an opening or slot 54 for accommodating the key receiving portion 56 of the puck lock 41. The housing 21 also includes a channel shaped cross bar 42 welded to the roof 33, the side walls 31, 32 and the back wall 36. The cross bar 42 is made up of a channel component or channel 43 and a reinforcing bar 44 welded to the flanges of the channel 43. The back wall 37 of the housing 21 includes a slot 46, extending from the side wall 32 toward the central part of the back wall 37, which terminates at a tab 47 rigidly secured to and extending forwardly from the back wall 37. The tab 47 has an annular hole 48 for reception of the puck lock-locking bar, shown by broken lines 49 in FIG. 1. The back wall 37 has a pair of parallel guides 51, 52, which extend rearwardly and laterally forming a guide way 55 for a flat projection or palm 72 of the hook 22. The side wall 32 has a T shaped opening 53 for receiving the palm 72 of the hook 22.

Figure 6:
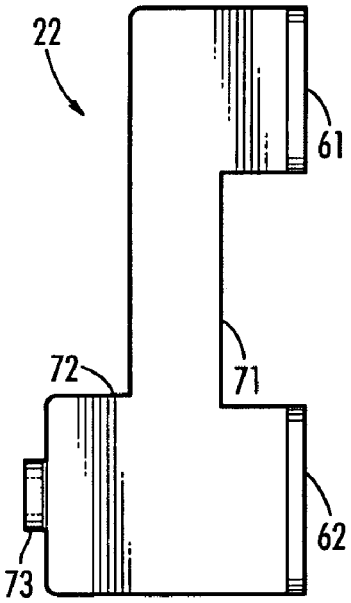
FIG. 6 is a front view of a stanchion hook.
Figure 7:
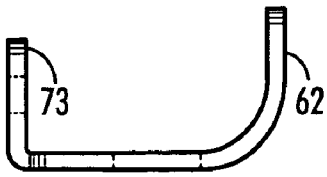
FIG. 7 is a side view of the stanchion hook shown in FIG. 6.

Referring also to FIGS. 6 and 7, the hook 22 includes a pair of vertically spaced upper and lower claws 61, 62 which are spaced apart a distance slightly greater that the vertical width of a pair of parallel pivot brackets 63, 64 welded to and extending laterally in cantilever fashion from the stanchion rod 13. A stanchion operating handle 66 is pivotally connected to the brackets 63, 64 by a pivot pin or rivet 67. A retainer catch and padlock, not shown, are normally provided for securing the handle to the door 14. However, such security items are too easily destroyed by vandals. As shown in FIG. 4 the laterally extending cross bar 42 is in front of the bracket 64, which prevents the stanchion from being pivoted about its axis 16 a sufficient angle to unlock the door 14. Any attempt to rotate the stanchion 12 clockwise as viewed in FIG. 4 will cause abutment of the housing 21 against the door 14. The hook 22 includes a vertically extending connector 71 between the claws 61, 62. The claws 61, 62 curl forward partially around the stanchion rod 13 terminating forwardly of the locking bar 42. A locking arm 73 is rigidly secured to and extends forwardly from and at a right angle to the end of the palm 72. The locking arm 73 is guided in the slot 46 of the back wall 37 and includes an annular locking rod receiving opening 74, which aligns with the opening 48 in the tab 47. As shown in FIG. 5, the trunk 77 of the T shaped opening 53 is slightly wider than the vertical width of the locking arm 73 and the rear portion 78 of the T shaped opening is slightly wider than the vertical width of the flat projection or palm 72 of the hook 22.

Figure 9:
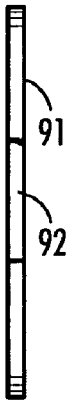
FIG. 9 is a side view of the puck shim shown in FIG. 8.
Figure 8:
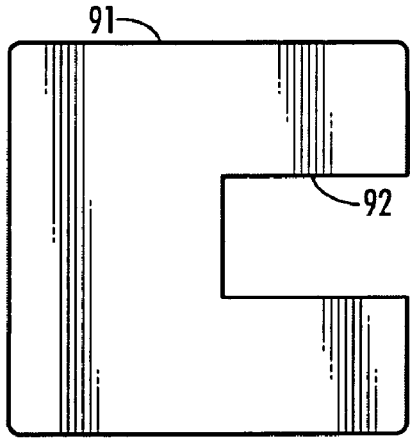
FIG. 8 is top view of a puck shim.

The locking bar as shown by broken lines 49 in FIG. 1 is slightly lower relative to the base of the hockey puck lock in some puck locks versus others. To accommodate such puck locks a spacer plate or shim 91 shown in FIGS. 8 and 9, is provided. The shin 91 has a notch 92 registering with the slot 46 formed in the back wall 37. FIG. 3 shows the shim 91 installed in the housing 21.

The herein disclosed security device 11 is portable, is easy to install and is a relatively inexpensive deterrent to thieves. When the security device is installed the claws 61, 62 are positioned on vertically opposite sides of the pivot brackets 63, 64 and the cross bar 42 extends in front of the stanchion rod 13 and between the ends of the claws 61, 62, thereby keeping the cross bar 42 in front of the bracket 64 and preventing the stanchion rod 13 from pivoting clockwise as viewed in FIGS. 3 and 4. This restraint on pivoted movement of the stanchion prevents opening of the container door 14. The cross bar 42 covers the pivot pin 67 thereby preventing the pin 67 from the being punched out and the cross bar 42 is also a deterrent to the brackets being sawed off.

What is claimed is:

1. A security device for a stanchion having a vertical rod to which an operating handle is pivotally connected on a horizontal axis by a pivot connection, said security device comprising, a housing having a pair of laterally opposite side walls, a back wall, a bottom wall and an upper wall defining a puck lock receiving cavity and including a slot in said back wall extending laterally inward from one of said side walls terminating at an end at a central part of said back wall, and a guide way on the rear side of said back wall extending laterally inward from said one side wall to said central part of said back wall, a forward extending tab rigidly secured to said back wall at said end of said slot, said tab having a laterally extending annular opening adapted for reception of a locking bar of a puck lock, an opening in said one side wall aligned with said slot and said guide way and a cross bar rigidly secured to said housing and extending laterally outward from said one side wall and in front of said pivot connection between said rod and said handle, and a hook including a flat palm having a portion with an end extending laterally into and guided by said guide way with a forward extending arm rigidly secured to said end of said portion, said arm having a laterally extending annular opening aligned with said opening of said tab and a pair of vertically spaced claws curving forwardly from said palm, said claws being adapted to partially encircle said stanchion rod above and below said pivot connection between said handle and said rod thereby limiting vertical displacement of said device relative to said stanchion and maintaining said cross bar in front of said pivot connection and said handle.

2. The security device of claim 1 wherein said housing includes a roof sloping upwardly and rearwardly from said cross bar.

3. The security device of claim 2 wherein said cross bar includes a channel member and a reinforcing component within said channel member.

4. The security device of claim 1 wherein said other laterally opposite side wall includes an opening with which the key receiving portion of said puck lock aligns when said puck lock is placed in said cavity.

5. The security device of claim 1 having a shim with a notch, said shim being between said back wall and said puck with said notch aligned with said slot in said back wall when said puck is placed in said cavity.

6. A security device for locking a vertical container door stanchion rod of the type having a lateral bracket to which a stanchion operating handle is pivotally connected, said device comprising:

a puck lock with a reciprocatable locking bar, a housing having a pair of laterally spaced side walls, a T shaped opening in one of said side walls a bottom wall, an upper wall, a back wall, said walls defining a cavity for reception of said puck lock.

a slot in said back wall extending from said one side wall and having an end at a central part of said back wall, a tab rigidly secured to said back wall at said end of said slot and extending forwardly from said back wall, said tab having a laterally extending annular opening, said back wall having a laterally extending guide way on its back side extending laterally inward from said T shaped opening, a cross bar rigidly secured to the front of said housing and extending laterally outward from said one side wall a sufficient distance to cover the front side of said lateral bracket when said one side of said housing is placed next to said stanchion rod, and a hook having a flat palm and a pair of vertically spaced claws curving forwardly from said palm, said claws being spaced apart a distance slightly greater than the vertical width of said bracket and said flat palm being in guided relationship relative to said guide way and including a forwardly extending arm with a lateral extending annular opening adapted to receive said locking bar of said puck lock when said flat palm is inserted into said guide way and said puck lock is installed in said cavity.

* * * * *